United States Patent [19]

Chandler

[11] Patent Number: 4,538,862

[45] Date of Patent: Sep. 3, 1985

[54] APPARATUS FOR SUPPORTINGLY ORGANIZING MISCELLANEOUS ARTICLES

[76] Inventor: Earl E. Chandler, P.O. Box 1624, Coolidge, Ariz. 85228

[21] Appl. No.: 416,969

[22] Filed: Sep. 13, 1982

Related U.S. Application Data

[63] Continuation-in-part of Ser. No. 261,600, May 7, 1981, abandoned, which is a continuation-in-part of Ser. No. 229,339, Jan. 29, 1981, Pat. No. 4,387,940, which is a continuation-in-part of Ser. No. 123,387, Feb. 21, 1980, Pat. No. 4,273,394, which is a continuation-in-part of Ser. No. 937,543, Aug. 28, 1978, Pat. No. 4,225,202.

[51] Int. Cl.[3] ..... A47B 81/00

[52] U.S. Cl. ..... 312/283; 312/184; 312/244

[58] Field of Search ..... 312/184, 244, 283, 284, 312/285, 235 R, DIG. 33, 11; 297/193; 211/181, 184

[56] References Cited

U.S. PATENT DOCUMENTS

| | | | |
|---|---|---|---|
| 999,189 | 7/1911 | Altvater | 211/181 X |
| 1,426,568 | 8/1922 | Hutshing | 312/11 |
| 1,887,539 | 11/1932 | Brown | 312/184 X |
| 2,734,790 | 2/1956 | Pospie | 312/244 X |
| 2,919,169 | 12/1959 | Jackson | 312/244 X |
| 3,378,134 | 4/1968 | Wilkinson et al. | 312/DIG. 33 |
| 3,642,338 | 2/1972 | Humphrey | 312/184 |
| 4,082,390 | 4/1978 | Gibson et al. | 312/244 X |
| 4,134,525 | 1/1979 | Respoli | 312/244 X |
| 4,240,684 | 12/1980 | Henning | 312/284 X |
| 4,387,940 | 6/1983 | Chandler | 206/349 X |

FOREIGN PATENT DOCUMENTS

| | | | |
|---|---|---|---|
| 838780 | 6/1960 | United Kingdom | 312/184 |

*Primary Examiner*—William E. Lyddane
*Assistant Examiner*—Thomas A. Rendos
*Attorney, Agent, or Firm*—Herbert E. Haynes, Jr.

[57] ABSTRACT

A pail-like enclosure is provided for carrying and demountably containing various especially configured article supporting and organizing assemblies.

13 Claims, 12 Drawing Figures

APPARATUS FOR SUPPORTINGLY ORGANIZING MISCELLANEOUS ARTICLES

CROSS REFERENCE TO RELATED APPLICATIONS

This application is a continuation-in-part of pending prior U.S. patent application Ser. No. 261,600, filed May 7, 1981, for Apparatus For Supportingly Organizing And Displaying Miscellaneous ARTICLES, now abandoned, which is a continuation-in-part of pending prior U.S. aatent application Ser. No. 229,339, filed Jan. 29, 1981, for Apparatus For Supportingly Organizing And Displaying Miscellaneous Articles, now U.S. Pat. No. 4,387,940 which is a continuation-in-part of application Ser. No. 123,387, filed Feb. 21, 1980, for Apparatus For Supportingly Organizing And Displaying Miscellaneous Articles, which issued on June 16, 1981 as U.S. Pat. No. 4,273,394, and which is in turn a continuation-in-part of U.S. patent application Ser. No. 937,543, filed on Aug. 28, 1978, for Apparatus For Supportingly Organizing And Displaying Miscellaneous Articles, which issued on Sept. 30, 1980 as U.S. Pat. No. 4,225,202, all by the same inventor.

BACKGROUND OF THE INVENTION

1. Field of the Invention

This invention relates generally article supporting structures and more particularly to an apparatus for supportingly organizing miscellaneous articles with the apparatus being particularly well suited for use in organizingly carrying fishing tackle, sewing supplies, and the like.

1. Description of the Prior Art

Many article supporting and/or carrying structures have been devised for various articles, such as tools, fishing tackle, sewing supplies, and the like, with these prior art structures most often being in the form of a box with a hinged lid and having several drawers, trays, or other compartments formed therein. Such structures, although serving the purpose, are not always convenient to use, in that the various types of compartments are usually intended to contain a multiplicity of articles which can make access to an individual article somewhat difficult and this often delays the locating of a desired one of the articles.

In addition to box shaped article carrying structures, the prior art is replete with cabinet structures for containing various articles which are usually supported on shelves or contained within drawers. These cabinet structures often provide the same difficulties as the above described boxes with regard to access to and location of individual articles, particularly when a plurality of relatively small articles are involved.

In general, the enclosing portions of the above prior art structures, i.e., the box and the cabinet, serve a single purpose which is simply to enclose the article supporting shelves, drawers, trays or other compartments and this limits the overall utility of such structures.

Therefore, it is desirable to provide a new and improved apparatus for supportingly organizing miscellaneous articles which overcomes some of the problems and shortcomings of the prior art.

SUMMARY OF THE INVENTION

In accordance with the present invention, a new and useful apparatus is disclosed for supportingly carrying miscellaneous articles in an organized manner and including a special enclosing portion which is a dual-purpose structure.

Although it is not intended that the apparatus of this invention be limited to a particular field of use, it will be appreciated from the following description that the apparatus is particularly well suited for supportingly carrying fishing tackle.

The apparatus includes an article support/organizer means which is in the form of a support means for demountably carrying in the preferred embodiments at least one article carrying organizer panel with the support means and organizer panel being removably contained within a pail enclosure means. The article carrying organizer panel is demountably carried on the support means with both the panel and the support means being removable from the pail enclosure means to free the pail for other uses of the general kind usually associated with pails. More specifically, the organizer panel, carrying various items of fishing tackle, and the support means may be removed from the pail enclosure means upon arrival at a fishing campsite so that the pail may be used to carry water or for various other campsite tasks.

In a first embodiment, the support means of the article support/organizer means includes a base, in the form of a circular tray, with an axially extending dowel, or rod, which has means thereon for demountably carrying a plurality of cantilever arms so that they extend radially therefrom. Each of the arms is configured to demountably support one of the organizer panels, with each of the panels being provided with means, such as hooks, trays, and the like, for carrying the various articles. The pail enclosure means of this embodiment is a conventional pail of circular cross section and having a suitable lid for demountable placement on the upwardly opening end of the pail. The circular base tray portion of the support means is sized so as to closely fit in the bottom of the pail for stabilized positioning of the support means and panels when they are positioned in the pail enclosure means.

In a second embodiment, the pail enclosure means is in the form of a quadrilateral in cross section structure with a suitable closing lid. The base of the support means is in the form of a quadrilateral tray which matches the bottom of the pail enclosure means and an upstanding planar panel is provided in the base tray to demountably support the cantilever arms on the opposite sides thereof, with the article supporting organizer panels being carried by the arms.

In still another embodiment, the pail enclosure means is configured to be disposed in a downwardly opening attitude when it is being used to enclose the article support/organizer means. In one form of this embodiment, the base tray of the support means also serves as the enclosing lid for the pail enclosure means with suitable clasp fasteners being provided to secure the base tray/lid to the pail enclosure means.

A modified form of article support/organizer means, which may be employed in any of the above described structures, includes an appropriately configured base tray having an upstanding tubular standard. The standard has an endless upper rim upon which a plurality of article carrying organizer panels are demountably carried so that they hang on the periphery of the standard. A plurality of article carrying organizer trays are vertically spacedly arranged on a center post to provide an article supporting insert which may be demountably placed in the bore of the standard of this modified form of the support means. Various other article carrying structures may be used in conjunction with the tubular standard. For example, ring shaped trays may be coaxially placed on the periphery of the standard.

Accordingly, it is an object of the present invention to provide a new and improved apparatus for supportingly organizing miscellaneous articles.

Another object of the present invention is to provide a new and improved apparatus for supportingly organizing miscellaneous articles which includes a special dual-purpose enclosing structure.

Another object of the present invention is to provide a new and improved apparatus for supportingly organizing miscellaneous articles of the above described character wherein the dual-purpose enclosing structure includes a pail enclosing means which in conjunction with serving as an enclosure for the present apparatus may additionally be employed for accomplishing tasks of the type associated with a pail.

Another object of the present invention is to provide a new and improved apparatus for supportingly organizing miscellaneous articles of the above described character wherein a support means is demountably positionable within the pail enclosure means with the supporting means providing for demountable supporting of article carrying organizer panels thereon.

Another object of the present invention is to provide a new and improved apparatus for supportingly organizing miscellaneous articles of the above described character wherein the support means may be configured to support article carrying organizer trays in addition to the article carrying organizer panels.

Still another object of the present invention is to provide a new and improved apparatus for supportingly organizing miscellaneous articles of the above described character wherein the article carrying organizer panels are planar structures adapted to be suspendingly supported on the support means with the panels being suitably provided with fastener means and/or container means in accordance with the types of articles to be supported thereon.

The foregoing and other objects of the present invention, as well as the invention itself, may be more fully understood from the following description when read in conjunction with the accompanying drawings.

DESCRIPTION OF THE PREFERRED EMBODIMENTS

Figures 1, 2:
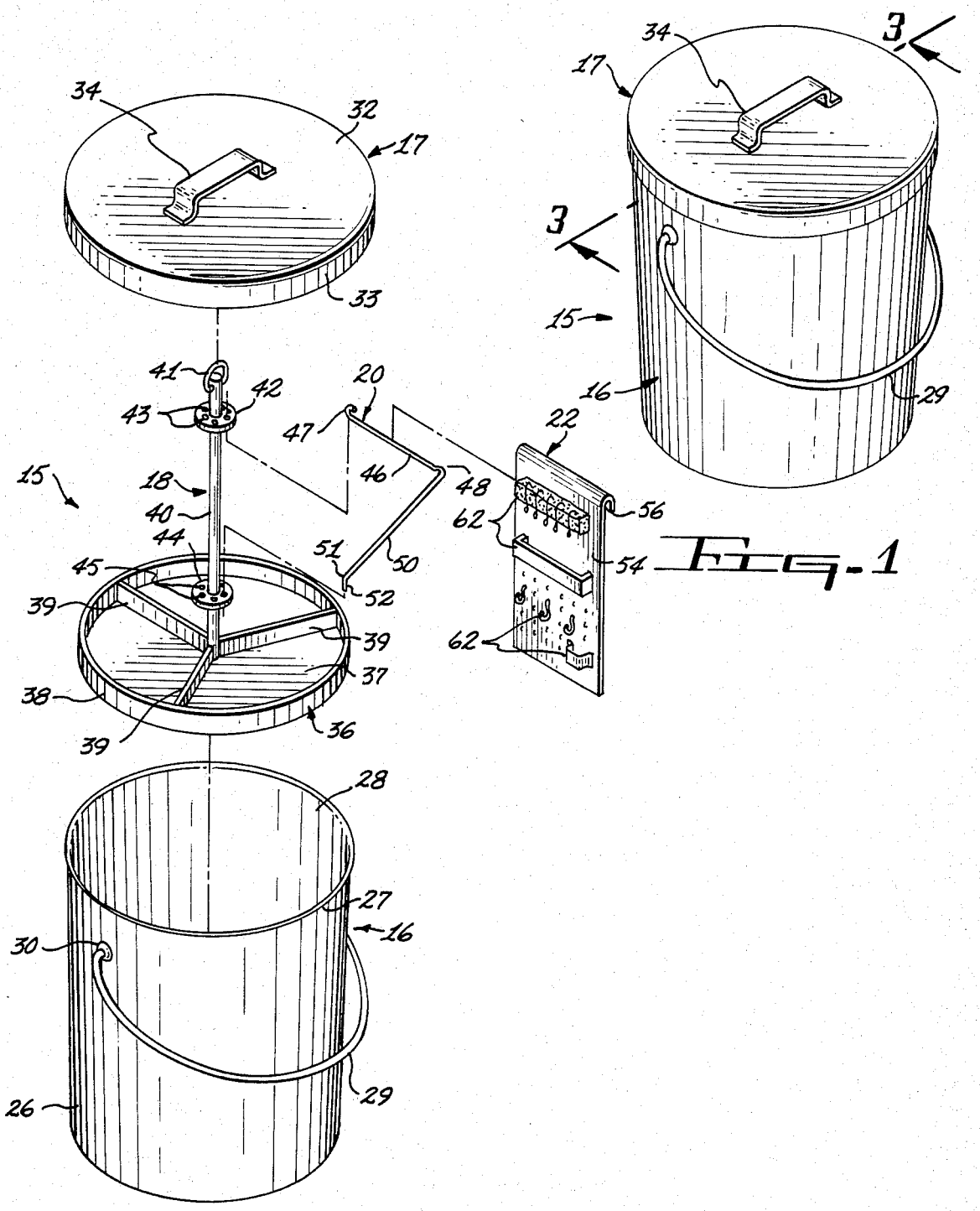
FIG. 1 is a perspective view of the preferred embodiment of the apparatus of the present invention.
FIG. 2 is an enlarged perspective exploded view of the apparatus of FIG. 1 showing the various features thereof.
Figure 3:
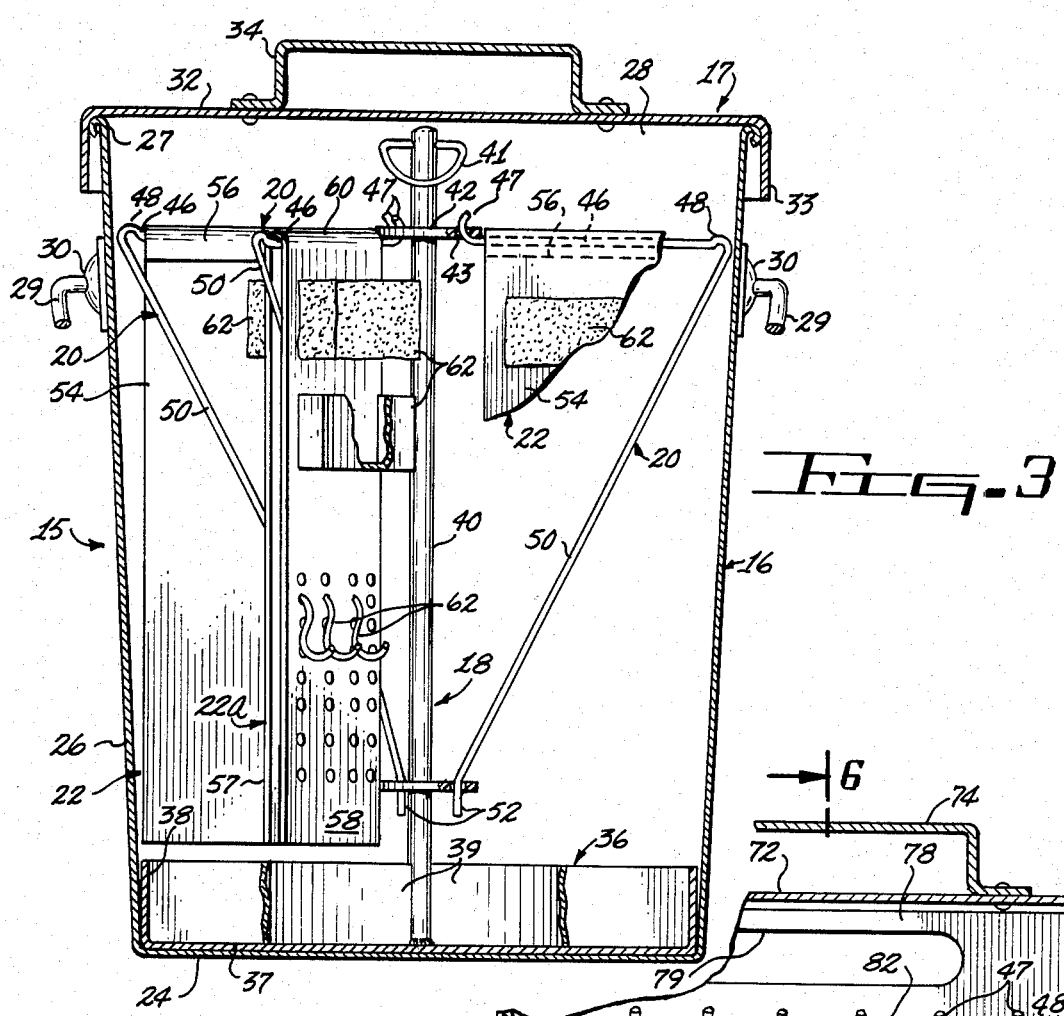
FIG. 3 is an enlarged sectional view taken along the line 3—3 of FIG. 1.

Referring more particularly to the drawings, wherein FIGS. 1, 2 and 3 illustrate the preferred embodiment of the apparatus of the present invention with this form of the apparatus being indicated generally by the reference numeral 15.

As will hereinafter be described in detail, the apparatus 15 includes the major components of a pail enclosure means 16 having a lid 17 for demountable positioning thereon, with the pail enclosure means and the lid cooperatively serving as a removable enclosing container for an article support/organizer means which includes a support means 18 that is adapted to demountably carry a plurality of cantilever arms 20 upon which article carrying organizer panels 22 are suspendingly and demountably mounted.

The pail enclosure means 16 of this embodiment is of conventional configuration in that it has a circular bottom wall 24 with an endless upstanding sidewall 26 of upwardly increasing circular cross section and which terminates in a circular lip 27 which circumscribingly defines the open top 28 of the pail 16. And, the pail is provided with the usual bail 29 which is pivotably affixed on its opposite ends as at 30 to diametrially opposed sides of the pail's sidewall 26. To complete the enclosure of the apparatus 15, the lid 17 has a circular planar surface 32 with an endless depending flange 33, and a handle 34 is provided for demountable placement on the pail 16 for closing of the open top 28 thereof.

The support means 18, which is demountably positionable in the pail enclosure means 16 as seen best in FIG. 3, includes a base means 36 which is preferably in the illustrated form of a tray having a circular bottom wall 37 with an endless flange 38 extending upwardly a short distance from the periphery thereof. As shown, the base tray 36 is sized so that it nestingly fits in the bottom of the pail 16 with the bottom wall 37 of the base tray 36 being in contiguous engagement with the bottom wall 24 of the pail 16 and its peripheral flange 38 is in a close concentric position with the inwardly facing surface of the endless sidewall 26 of the pail 16. In this manner, the support means 18 is supportingly carried in the pail 16 and is restrained against unwanted lateral movements. The base tray 36 may be provided with suitable radially extending dividers 39 which may be fixed or repositionably mounted therein as desired.

A dowel, or rod, 40 is affixed so as to extend coaxially upwardly from the base tray 36 and a bail 41 is pivotably mounted thereon adjacent its upper end with the bail 41 being employed for lifting and lowering the support means 18 out of and into the pail 16. An upper circular disc 42 is concentrically affixed on the dowel 40 adjacent its upper end and this disc is formed with a plurality of radially spaced apertures 43 arranged in a concentric circular array thereon. A lower circular disc 44 is similarly affixed to the dowel rod 40 at a location adjacent but spaced upwardly from its lower end. The lower disc 44 is identical to the upper disc and has the plurality of apertures 45 formed therethrough.

Each of the plurality of apertures 43 of the upper disc 42 is in vertical alignment with a different one of the plurality of apertures 45 of the lower disc 44, with each aligned pair of the apertures being adapted to demountably support one of the plurality of cantilever arms 20.

Each of the cantilever arms 20 is formed, such as of a suitable gauge resilient metal rod, or relatively heavy wire, and has a horizontally extending leg 46 with an upwardly curving hook 47 formed on one end thereof. The opposite end of the horizontal leg 46 is formed with an upwardly curving hump 48 which is bent back on itself and from which a diagonally downwardly extending leg 50 of the cantilever arm 20 integrally extends. The diagonal leg 50 is bent as at 51 so that its free end 52 is disposed at an acute angle with respect thereto, with the free end 52 being seen to be in a substantially vertical attitude.

With the hook 47 of the horizontal leg 46 placed in hooked engagement within one of the apertures 43 of the upper disc 42, mounting of the cantilever arm 20 is simply completed by moving and slightly deforming the arm to bring the free end 52 into position above the aligned aperture 45 of the lower disc 44 and the inherent resiliency of the arm will cause the free end 52 to move into retained engagement within the aligned aperture 45 of the lower disc.

In this manner, the cantilever arms 20 are demountably carried on the support means 18 so as to extend radially therefrom. It will be appreciated that as few as one cantilever arm 20 may be mounted on the support means 18 with the maximum number being limited by the number of apertures 43 and 45 of the upper and lower discs 42 and 44, respectively.

The cantilever arms 20 are intended to demountably support the organizer panels 22 which may be formed of any suitable material, such as metal, plastic, and the like. The panels 22 include at least one planar surface 54 with a hook-shaped upper end as at 56, so that they may be hooked over the horizontal legs 46 of the cantilever arms 20 so as to be suspendingly mounted thereon. A modified form of the organizer panel is shown at **22*a* in FIG. 3. The modified panel 22*a* is formed with a pair of spaced coextending planar surfaces 57 and 58 which are integral to form a loop 60 at the uppermost end of the panel 22*a* so that this type of panel may be loopingly suspended on the horizontal legs 46 of the cantilever arms 20**.

In any event, the planar surfaces 54, 57 and 58, respectively, of the organizer panels 22 and **22*a*, are provided with suitable article fastener-container means 62** which may be in any of many suitable forms such as the illustrated examples of hooks, bins, pin cushion structures, and the like.

Figure 4:
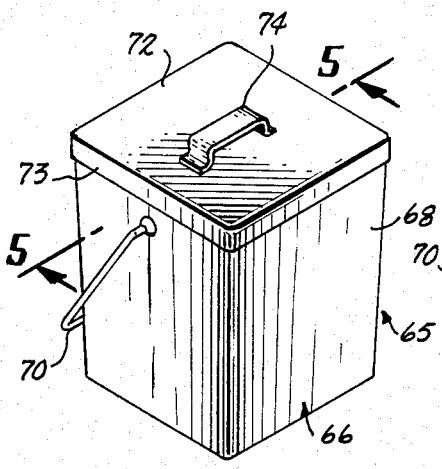
FIG. 4 is a perspective view of a second embodiment of the apparatus of the present invention.
Figure 5:
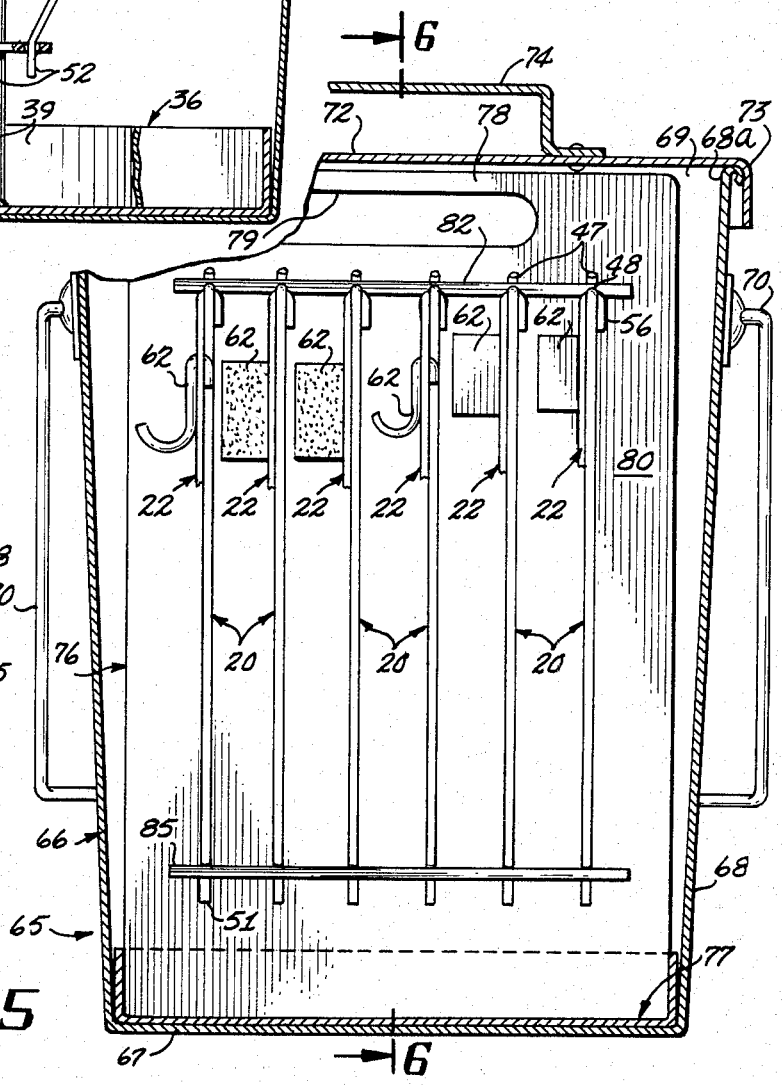
FIG. 5 is an enlarged fragmentary sectional view taken along the line 5—5 of FIG. 4.
Figure 6:
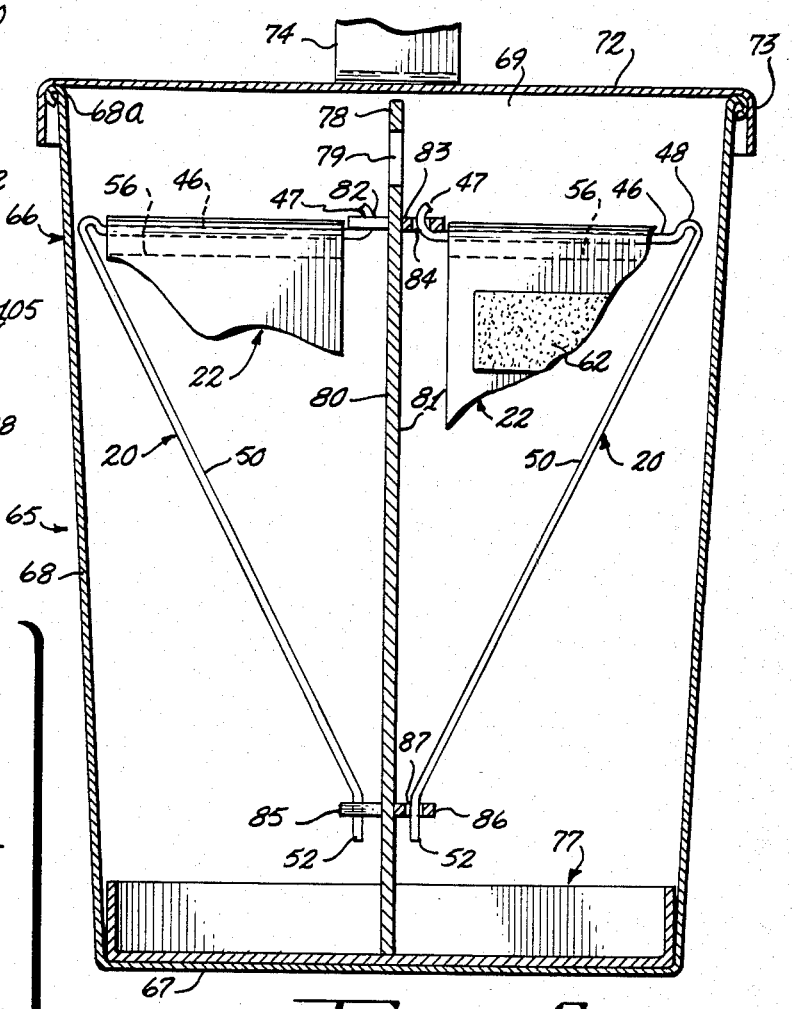
FIG. 6 is a sectional view taken along the line 6—6 of FIG. 5.

Referring now to FIGS. 4, 5 and 6, wherein a second embodiment of the apparatus of the present invention is shown, with this apparatus being indicated generally by the reference numeral 65. The pail enclosure means 66 of this embodiment is provided with a quadrilateral bottom surface 67, such as square, with an endless four sided sidewall 68 extending upwardly therefrom and terminating in an endless lip **68*a* which defines the upper open top 69 of the pail 66. The pail has an appropriately configured bail 70 pivotably mounted thereon. The demountable top closing lid 72 is similarly of quadrilateral configuration with a four sided depending flange 73 and has a suitable handle 74** thereon.

Since the pail 66 defines a quadrilateral in cross section bore, as opposed to the circular bore of the previously described embodiment, the support means 76 of the article support/organizer means will obviously be of different configuration to suit that quadrilateral bore. Therefore, the support means 76 is provided with a base means 77 in the preferred form of an upwardly opening tray of matching quadrilateral configuration so that the support means 76 nestingly fits in the bottom of the pail 66. It will be appreciated that the hereinbefore described dowel rod 40 with its apertured discs 42 and 44 could be employed with the quadrilateral bore tray 77 to complete the support means 76 of this embodiment. However, for more efficient space utilization, the support means 76 instead is provided with an upstanding planar wall 78 having a hand grip opening 79 formed therethrough adjacent its upper end. Each of the opposite planar surfaces 80 and 81 of the upstanding wall 78 have a ledge 82 and 83, respectively, provided thereon adjacent the upper edge of the wall, and disposed so as to extend normally and oppositely therefrom. Each of these upper ledges 82 and 83 are provided with a plurality of apertures 84 formed therethrough with the apertures being linearly arranged along the lengths of their respective ledges. Similarly, the upstanding wall 78 is provided with a pair of lower ledges 85 and 86 which extend normally and oppositely from the opposite surfaces 80 and 81 of the wall 78, with these lower ledges 85 and 86 having plural apertures 87 formed therethrough in the same manner as the upper ledges 82 and 83.

With the support means 76 configured as described, the hereinbefore fully discussed cantilever arms 20 may be demountably supported by the ledges 82, 83, 85 and 86, on opposite sides of the upstanding wall 78 and the organizer panels 22 and/or **22*a*** may be suspending mounted thereon as previously described.

Figure 7:
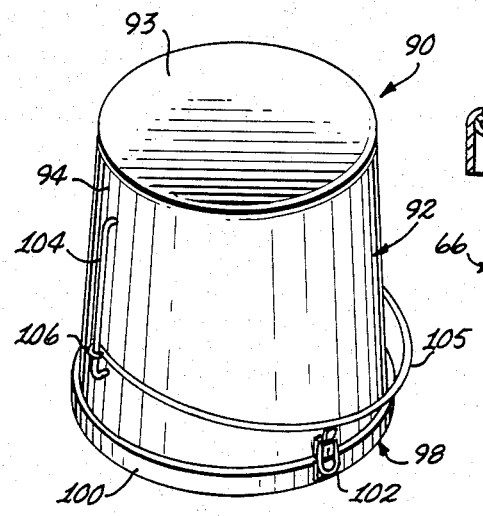
FIG. 7 is a perspective view of a third embodiment of the apparatus of the present invention.
Figure 8:
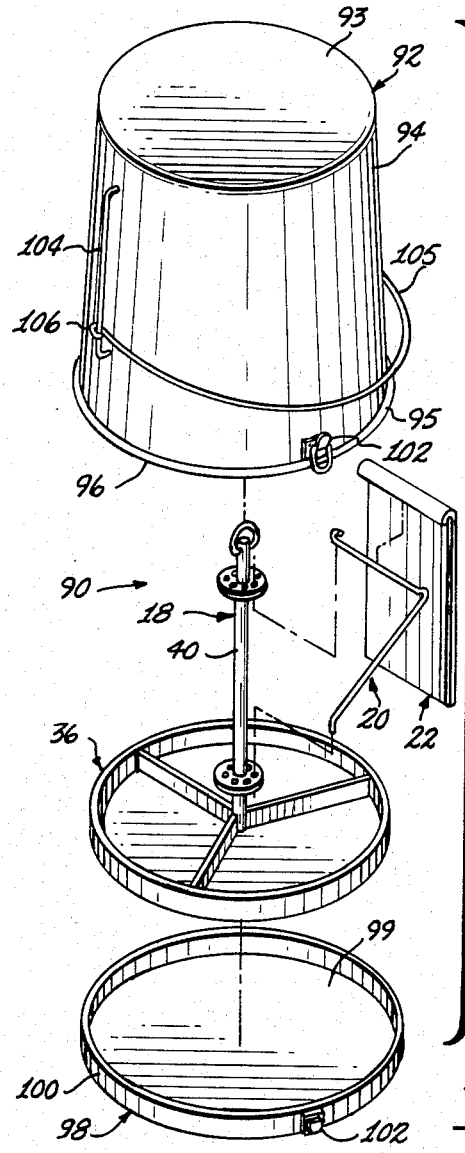
FIG. 8 is an exploded perspective view of the apparatus of FIG. 7 showing the various features thereof.

Referring now to FIGS. 7 and 8, wherein a third embodiment of the apparatus of the present invention is shown with this apparatus being indicated generally by the reference numeral 90. The pail enclosure means 92 of the apparatus 90 is configured similarly to the pail enclosure 16 of the hereinbefore described first embodiment. The pail enclosure means 92 is, however, inverted so that it has a circular top wall 93 with an endless sidewall 94 of downwardly increasing circular cross section which terminates in an endless lip 95 which defines the open bottom 96 of the pail. The closing cover 98 is formed with a circular planar surface 99 with an upstanding circular flange 100 and is designed to nestingly receive the open bottom end 96 of the pail 92 for demountable closing thereof. Since gravitational forces will not hold the cover 98 in place as was the case in the two previously described embodiments, the pail 92 and cover 98 are provided with complimentary elements of a suitable latch means 102.

The pail enclosure means 92 is provided with a diametrically opposed pair of fixedly attached elongated staples 104 (one shown) to which the bail 105 is loosely attached by means of suitable loops 106 (one shown) on each of its opposite ends. In this manner, the bail 105 will slidably move on the staples 104 to a position proximate the closed top wall 93 of the pail 92 when the apparatus 90 is being carried. When the pail 92 is removed from the article support/organizer means, for use in accomplishing other pail functions, the bail 105 will slidably move to the opposite ends of the staples 104 to facilitate such other uses of the pail.

The preferred form of the article support/organizer means used in this embodiment and, which is hereinbefore fully described, has its support means 18 nestingly positionable in the upwardly opening cover 98 of the apparatus 90, so that it will extend axially upwardly into the pail enclosure means 92. The cantilever arms 20 and organizer panels 22 and/or 22*a*, are supportingly carried on the support means 18 as previously described.

Figure 9:
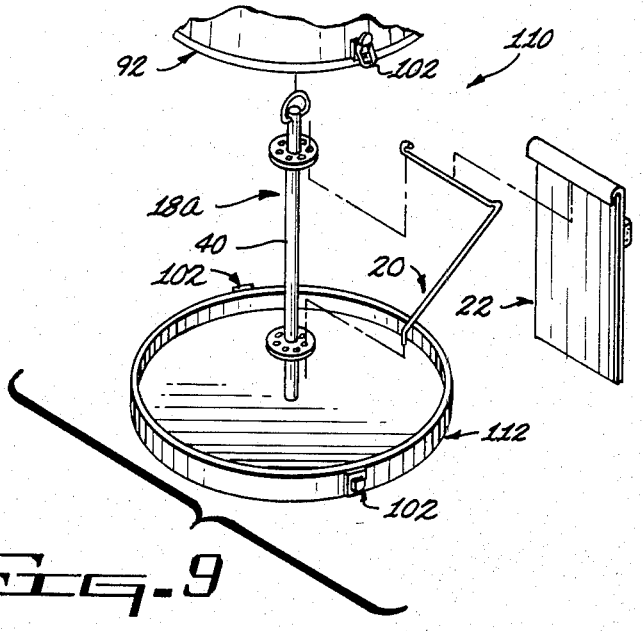
FIG. 9 is a fragmentary perspective view similar to FIG. 8 but showing a modification of that embodiment.

FIG. 9 shows a modification of the apparatus shown in FIGS. 7 and 8, with this modification being identified generally by the reference numeral 110. The pail enclosure means of this modified apparatus 110 is identical to pail enclosure means 92 and will therefore be referred to by the same reference numeral. The article support/organizer means includes a support means 18*a* which is similar to the previously described support means 18, except that the base tray 112 thereof is diametrically enlarged so that it serves as a cover for the pail enclosure means 92 and thus eliminates the need for a separate lid, or cover, such as that identified as number 17 in the hereinbefore described apparatus 15. With the base tray 112 serving as the lid in this embodiment, it, along with the pail 92 are provided with the complementary elements of the demountable latch means 102.

Figure 11:
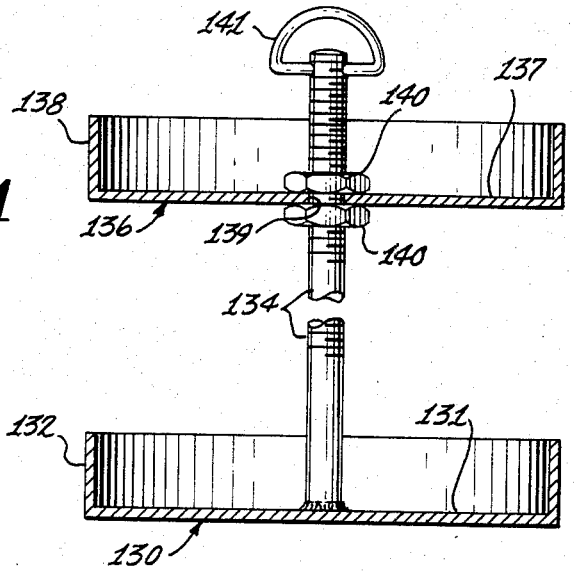
FIG. 11 is a fragmentary sectional view taken along the line 11—11 of FIG. 10.
Figure 10:
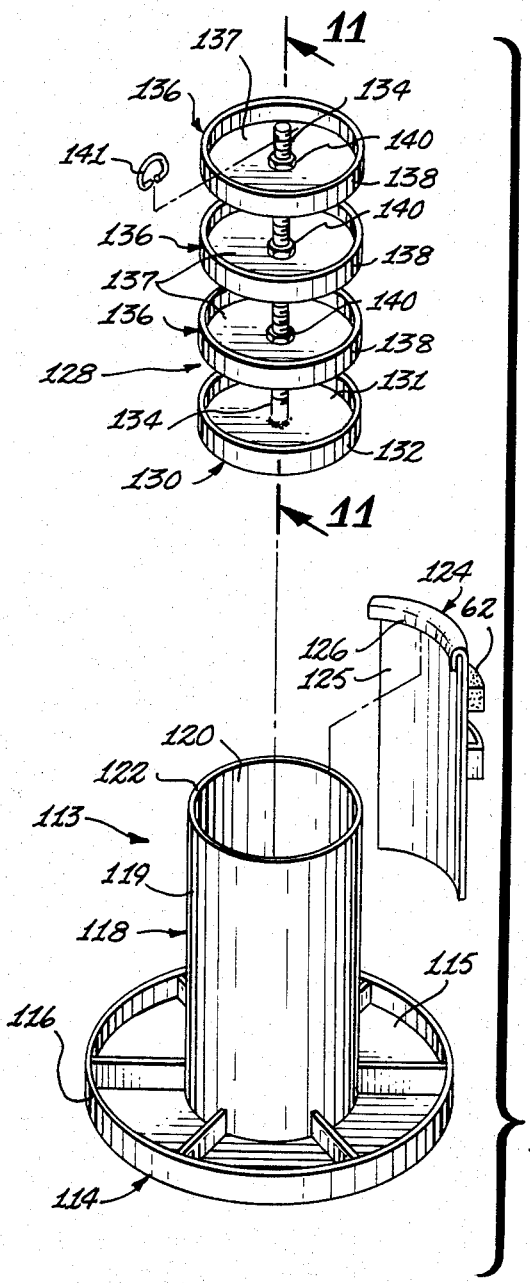
FIG. 10 is an exploded perspective view illustrating a modified form of the article supporting structure for use in the apparatus of the present invention.

Reference is now made to FIGS. 10 and 11, wherein a further embodiment of the article support/organizer means is illustrated. It will be understood that although not shown, this article support/organizer means may be removably inserted into any of the hereinbefore disclosed pail enclosure means in the same manner as the previously disclosed article support/organizer means.

In this embodiment, the support means, which is indicated in its entirety by the reference numeral 113, includes a base means 114 in the preferred form of an upwardly opening tray having a circular planar wall 115 with an upstanding peripheral flange 116, with the base tray being sized to nestingly fit within the pail enclosure means in the same manner as described above. A further standard 118 extends axially and upwardly from the base tray 114 and includes an endless sidewall 119, which is preferably circular in cross section so as to define a cylindrical bore 120. The standard 118 terminates on its upper end with an endless lip 122 which circumscribes the open upper end of the cylindrical bore 120 thereof.

A plurality of organizer panels 124 (one shown) are demountably carried on the standard 118 and to accomplish such mounting, the panels are each provided with elongated members 125 which is curved transverse to the longitudinal dimension thereof so as to substantially match the curved segment of the periphery of the standard 118. The upper edge of the elongated member 125 is bent back on itself to form a hook 126 which is demountably placeable in hooked engagement on the lip 122 of the standard 118. The outer, or convex, surface of the panel 124 is provided with article fastener-container means 62 as previously described. It will be understood that, although not shown, the illustrated and described panels 124 may be modified so that they hang inside the bore 120 of the standard 118, or they may be configured with two arcuately curved spaced elongated members (not shown) in the manner similar to the hereinbefore described panel 22*a*.

The bore 120 of the tublar standard 118 may be utilized for storage as is, i.e., without any article organizing and carrying devices being provided therein. This would be ideal for use in storing some articles, such as yarn, when the apparatus is employed as a sewing equipment container, or fishing reels when the apparatus is used for a fishing tackle container.

An alternative to leaving the bore 120 of the standard 118 empty, is illustrated in FIG. 10 wherein an organizer means in the preferred form of a removably insertable stacked tray device is shown, which is identified generally by the reference numeral 128.

The stacked tray device 128 includes a base tray 130 having a circular bottom 131 with an endless upstanding peripheral flange 132. An elongated threaded rod 134 extends axially upwardly from the base tray 130 for supportingly carrying a plurality of additional trays 136. The trays 136 also have circular bottoms 137 with upstanding peripheral flanges 138. The circular bottoms 137 of each of the trays 136 are formed with an axial aperture 139, as shown typically in FIG. 11, for receiving the threaded rod 134. Suitable jamb nuts 140 are threadingly carried on the rod 134 for adjustably mounting the trays 136 thereon.

The stacked tray device 128 further includes a bail 141 pivotably removably mounted on the uppermost end of the threaded rod 134 to facilitate insertion and removal of the stacked tray device relative to the standard 118.

Figure 12:
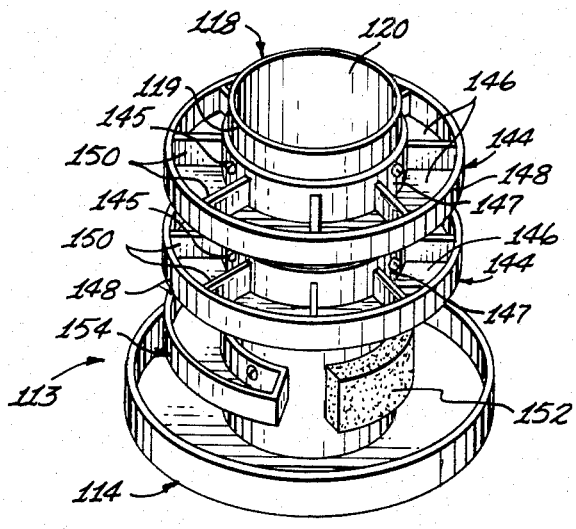
FIG. 12 is a view similar to FIG. 11 and illustrating variations of the structure illustrated in that figure.

Another modified form of article support/organizer means is illustrated in FIG. 12, with this modified form using the above described support means 113. As shown, the tubular standard 118 has organizer means such as the illustrated plurality of ring-shaped trays 144 fixedly attached thereon, such as with suitable screws 145, in axially spaced positions along the length of the standard, so that the trays 144 are in circumscribingly coaxial dispositions thereon. Each of these ring-shaped trays 144 have a ring-shaped bottom surface 146 with a cylindrical tubular hub 147 which allows them to be axially slidingly positioned on the standard 118, and have endless upstanding peripheral flanges 148. The trays 144, which provide the fastener-container means, may be provided with suitable radial partitions 150 to provide plural article containment bins in each tray.

Various other article fastener-container devices may be provided on the periphery of the standard 118 such as the illustrated pin cushion structure 152 for holding pins, needles, fish hooks, and the like, and semi-ring shaped trays 154 (one shown).

It will be appreciated from the above that a great variety of article containment and/or retaining structures, and fastener-container devices can be utilized in conjunction with the support means 113, and it is not intended that this invention be limited to the specific devices illustrated and described herein.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A portable apparatus for supportingly carrying miscellaneous articles in an organized manner comprising in combination:

(a) a pail enclosure defining an internal chamber which is closed on one end and open on the other; and (b) a free standing article support/organizer demountably carried in the internal chamber of said pail enclosure and supported by the closed end of said pail enclosure, and including, I. a planar tray having an upstanding peripheral flange, II. an elongated rod extending upwardly from the center of said tray, III. an upper disc fixed on said rod adjacent the upper end thereof and disposed to lie in a plane transverse to the longitudinal axis of said rod, IV. a lower disc fixed on said rod in downwardly spaced relationship with said upper disc and substantially parallel therewith, V. at least five cantilever arms mounted in radially spaced increments about said rod on said upper and lower discs and each pivotably movable about different vertical axes which pass through said upper and lower discs, VI. at least five rigid panels each demountably suspended from a different one of said plurality of cantilever arms, VII. fastener-container means on each of said panels for supportingly carrying the miscellaneous articles in an organized manner.

2. An apparatus as claimed in claim 1 wherein said pail enclosure comprises:

(a) a planar wall for closing the one end;

(b) an endless sidewall extending integrally from the peripheral edge of said planar wall and having an endless extending edge;

(c) said planar wall and said endless sidewall cooperatively defining the internal chamber; and (d) said endless extending edge of said endless sidewall defining the open other end.

3. An apparatus as claimed in claim 2 wherein said pail enclosure further comprises a bail having its opposite ends attached to the opposite peripheral sides of said endless sidewall.

4. An apparatus as claimed in claim 1 and further comprising a cover demountably mounted on the open end of said pail enclosure.

5. An apparatus as claimed in claim 1 and further comprising a cover demountably mounted on the open end of said pail enclosure and complimentary elements of a latch means on said cover and on said pail enclosure for demountably latching said cover on said pail enclosure.

6. A portable apparatus for supportingly carrying miscellaneous articles in an organized manner comprising in combination:

(a) a pail including,

I. a planar wall,

II. an endless sidewall extending integrally from the peripheral edge of said planar wall and having an endless extending edge, III. said planar wall and said endless sidewall cooperatively defining an internal chamber closed on one end and said endless extending edge defining an opening; and (b) a free standing article support/organizer means demountably positioned in the internal chamber of said pail and supported by the closed end of said pail, and including, I. a base tray, II. a support rod integral with said base tray and extending upwardly and normally therefrom, III. an upper disc on said support rod adjacent the top and disposed in a plane transverse to the longitudinal axis of said support rod, IV. a lower disc on said support rod in downwardly spaced relationship with said upper disc and parallel therewith, V. at least five cantilever arms mounted in radially spaced increments about said support rod on said upper and lower discs and each pivotably movable about a different vertical axes which pass through said upper and lower discs, VI. a rigid panel demountably suspended from each of said plurality of cantilever arms, VII. fastener-container means on each of said panels for supportingly carrying the miscellaneous articles in an organized manner.

7. An apparatus as claimed in claim 6 wherein said base tray is in contiguous resting engagement with the inwardly facing surface of said planar wall and has a peripheral configuration which substantially matches that of said planar wall to locate the periphery of said base tray proximate the inwardly facing surface of said endless sidewall.

8. An apparatus as claimed in claim 6 and further comprising a cover demountably mounted on the endless extending edge of said endless sidewall for closing the opening defined thereby.

9. An apparatus as claimed in claim 8 wherein said base tray is in contiguous resting engagement with the inwardly facing surface of said cover and has a peripheral dimension which substantially matches that of said cover to locate the periphery of said base tray proximate the inwardly facing surface of said endless sidewall.

10. An apparatus as claimed in claim 6 wherein said base tray is configured for supportingly carrying the miscellaneous articles in an organized manner and having a planar surface with an endless flange integral with and extending upwardly from the peripheral edge of said planar surface.

11. An apparatus as claimed in claim 10 wherein said base tray further comprises at least one partition for compartmentalization thereof.

12. An apparatus as claimed in claim 6 wherein said plurality of cantilever arms each comprises:

(a) a horizontally extending leg with means on one end thereof for demountable attachment to said upper disc means; and (b) a diagonal leg extending integrally and downwardly from the other end of said horizontally extending leg with means on the lower end of said diagonal leg for demountable attachment to said lower disc means.

13. An apparatus as claimed in claim 12 wherein each of said rigid panels has hook means on its upper end for demountable engagement with said horizontally extending leg for suspended mounting of said panel.

* * * * *